US005941733A

United States Patent [19]

Lai

[11] Patent Number: 5,941,733

[45] Date of Patent: Aug. 24, 1999

[54] UNIVERSAL SERIAL BUS PLUG CONNECTOR

[75] Inventor: Chin-Te Lai, Tao-Yuan Hsien, Taiwan

[73] Assignee: Hon Hai Precision Ind. Co., Ltd., Taipei Hsien, Taiwan

[21] Appl. No.: 08/922,163

[22] Filed: Sep. 2, 1997

[30] Foreign Application Priority Data

Aug. 31, 1996 [TW] Taiwan ..... 85213590
Sep. 26, 1996 [TW] Taiwan ..... 85215055

[51] Int. Cl.[6] ..... H01R 9/03

[52] U.S. Cl. ..... 439/610; 439/906

[58] Field of Search ..... 439/607, 609, 439/610, 906

[56] References Cited

U.S. PATENT DOCUMENTS 5,158,481 10/1992 Frantz ..... 439/607
5,273,459 12/1993 Davis ..... 439/607
5,409,400 4/1995 Davis ..... 439/906
5,683,269 11/1997 Davis et al. ..... 439/607
5,725,395 3/1998 Lee ..... 439/108 X

*Primary Examiner*—Khiem Nguyen

[57] ABSTRACT

A Universal Serial Bus plug connector consists of a lower shielding shell defining an opened top about a rear portion thereof. A dielectric body mounted with a number of contacts is mounted to the lower shielding shell, wherein a terminal portion of the contacts for connecting with leads of a cable is located under the opened top. An upper shielding shell has a top wall covering the opened top of the lower shielding shell, and two first side walls connected with two second side walls of the lower shielding shell, wherein each first side wall defines a locking hole through which a locking key defined by each second side wall extends. Each locking hole has a width which is sufficiently larger than that of each locking key. A retaining member consisting of a pair of jaws is integrally formed at a rear side of the upper shielding shell. The jaws are moved to each other to securely clamp the cable therebetween.

16 Claims, 9 Drawing Sheets

UNIVERSAL SERIAL BUS PLUG CONNECTOR

BACKGROUND OF THE INVENTION

1. Field of The Invention

The invention relates to an electric connector, particularly to a Universal Serial Bus (USB) plug connector.

USB connectors are recently developed connectors which can be used to replace most of the input/out (I/O) connectors, for example, D-Sub connectors and Mini-Dins as can be seen in the back of a computer.

2. The Prior Art

Conventionally, a USB plug connector consists of a front shielding shell made of metal, a dielectric body mounted with four contacts, a cable with four leads, and a rear shielding shell. To assemble the connector, firstly, the dielectric body mounted with contacts is mounted in the front shielding shell. Then, the leads are brought to extend into the front shielding shell to be connected to the contacts by a soldering or crimping operation. Finally, the rear shielding shell is connected to the front shielding shell.

The conventional USB plug connector is found to have the disadvantages as set forth below.

Firstly, due to the structural limitation of the front shielding shell, a tool cannot be easily brought into the front shielding shell to approach the contacts to perform the necessary soldering or crimping operation to connect the contacts with the leads.

Secondly, the cable cannot be securely connected to the rear shielding shell, which causes the leads to be easily separated from the contacts when a pulling force is exerted to the cable relative to the connector.

Thirdly, when assembling the front and rear shielding shells, they must be precisely aligned with each other so that locking means formed thereon can be interconnected to securely connect the front and rear shielding shells. Such a requirement brings about that the assembly of the front and rear shielding shells is troublesome and time consuming.

Fourthly, the locking means on the connected front and rear shielding shells can only effectively resist a separating force in a specific direction. This means that the shielding shells may be easily separated from each other when a separating force is applied thereto in another direction.

Finally, the dielectric body cannot be easily and securely mounted into the front shielding shell.

Therefore, an objective of the invention is to provide an electrical connector, particularly a USB plug connector, with a lower shielding shell for receiving a dielectric body therein, wherein the lower shielding shell has a structure which can facilitate an easy approach of a tool thereinto in order to perform a soldering or crimping operation to connect contacts mounted to the dielectric body with leads of a cable.

Another objective of the invention is to provide an electrical connector, particularly a USB plug connector, which has an upper shielding shell connected with a lower shielding shell and a cable having four leads connected to four contacts, wherein the upper shielding shell can firmly connect with the cable so that even if a pulling force is exerted to the cable, the leads thereof will not easily separate from the contacts.

A further objective of the invention is to provide an electrical connector, particularly a USB plug connector, with an upper and lower shielding shell which can be easily assembled, without the necessity to precisely align locking means formed thereon.

Still a further objective of the present invention is to provide an electric connector, particularly a USB plug connector, with an upper and lower shielding shell which can effectively resist a separating force acting on them in either horizontal or vertical direction when they are connected.

Still another objective of the present invention is to provide an electric connector, particularly a USB plug connector, with a lower shielding shell and a dielectric body for mounting a number of contacts, wherein the dielectric body can be easily and securely mounted into the lower shielding shell.

SUMMARY OF THE INVENTION

According to an aspect of the invention, an electric connector, particularly a USB plug connector, includes a lower shielding shell having a top, bottom and two side walls cooperatively defining a front opening for receiving a mating connector. The lower shielding shell defines an opened top so that a tool can be easily brought into the lower shielding shell to perform a soldering/crimping operation to connect leads of a cable with contacts mounted to a dielectric body fixedly received in the lower shielding shell. An upper shielding shell has a top wall defining a hook-shaped tab extending forwards from a front edge thereof, and two locking holes in two side walls thereof. The hook-shaped tab is inserted into a rectangular hole defined by the top wall of the lower shielding shell, and the two side walls of the upper shielding shell defining the locking holes are fixedly engaged with two locking keys defined by the two side walls of the lower shielding shell, wherein each locking hole has a width which is sufficiently larger than that of each locking key. A cable retaining member is integrally formed on a rear side of the upper shielding shell. The cable retaining member fixedly engages with the cable.

BRIEF DESCRIPTION OF THE DRAWINGS

FIG. 2 (B) is a perspective view showing the plug connector in accordance with the first embodiment of the present invention in an assembled state;

DETAILED DESCRIPTION OF THE PREFERRED EMBODIMENTS

References will now be described in detail to the preferred embodiments of the invention. While the present invention has been described in reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
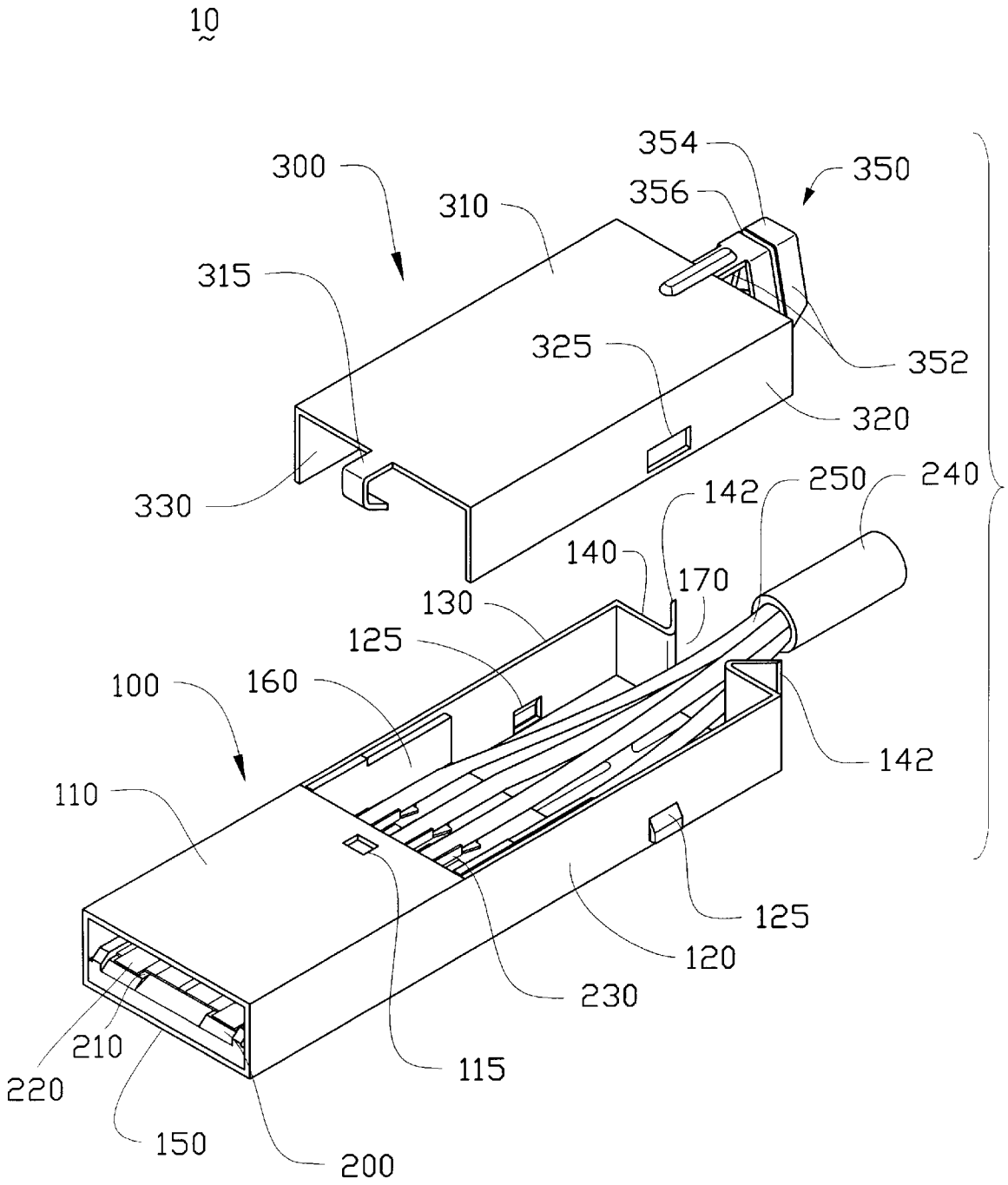
FIG. 1 is a perspective view showing a plug connector in accordance with a first embodiment of the present invention, wherein an upper shielding shell thereof is removed therefrom to show a connection between leads and contacts.
Figure 2A:
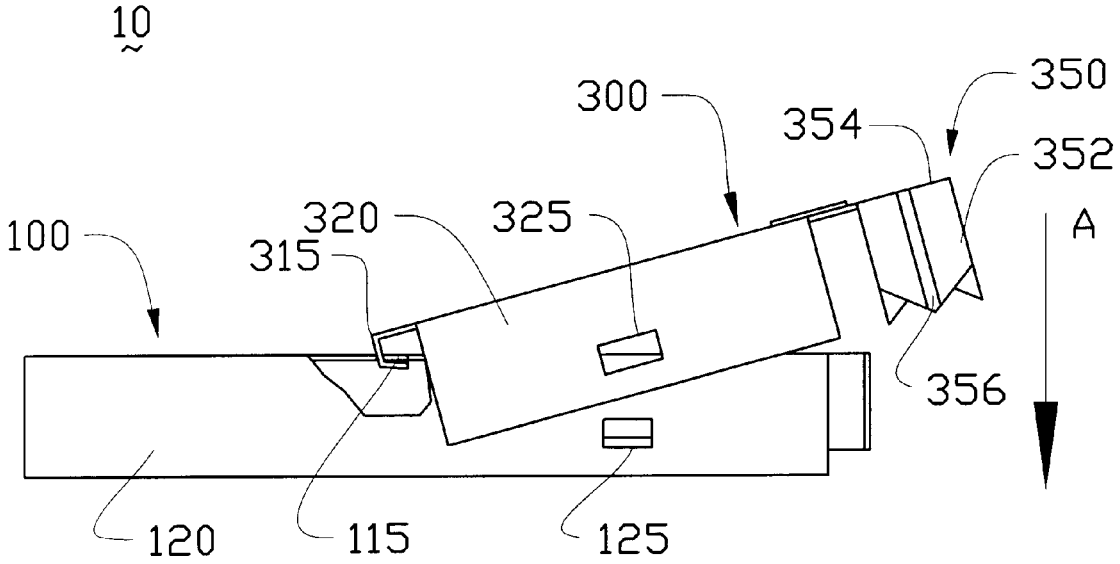
FIG. 2 (A) is a side view with a part cut away to show the manner how the upper shielding shell is connected to a lower shielding shell of FIG. 1.
Figure 2B:
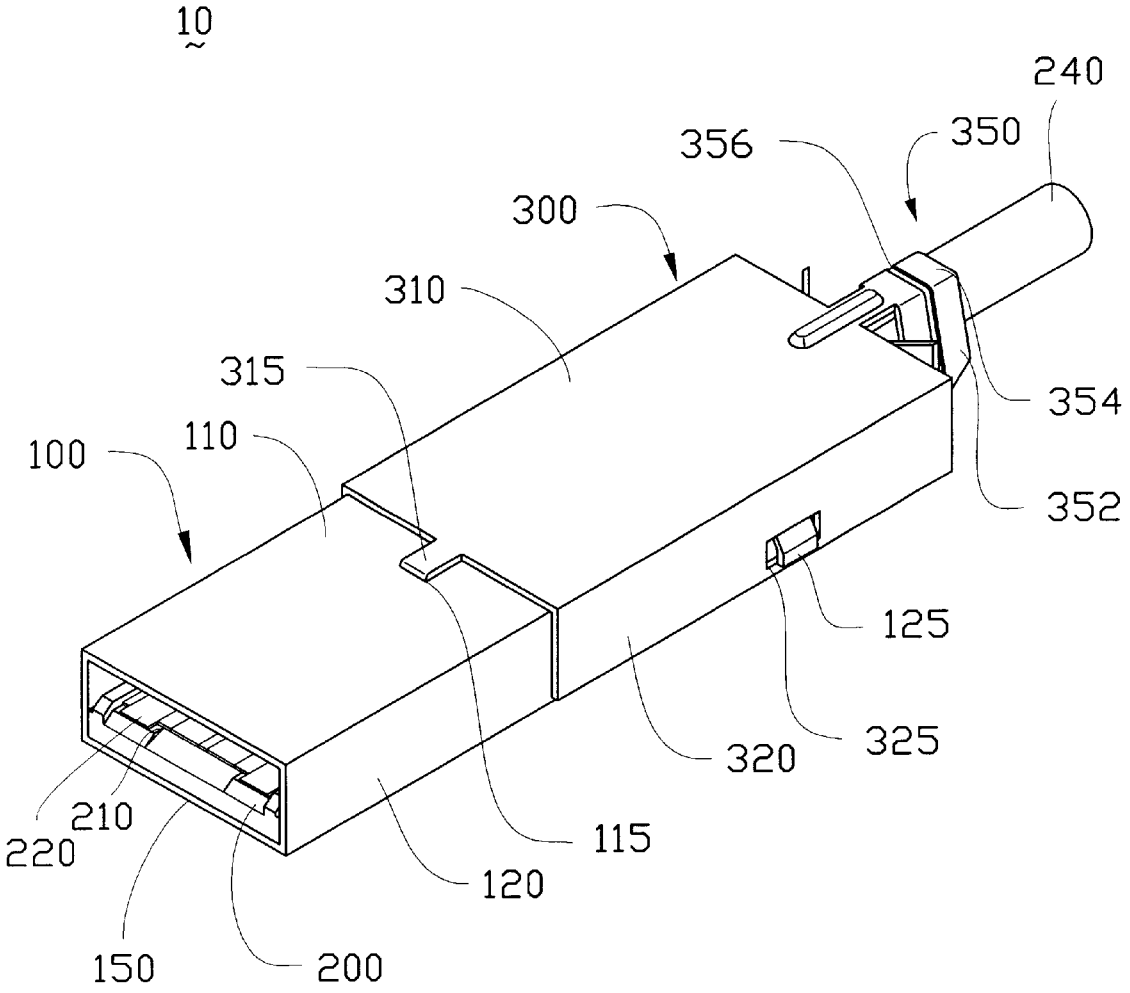

Referring to FIGS. 1 to 2(B), a USB plug connector in accordance with a first embodiment of the present invention is shown and indicated by referenced number 10. The connector 10 generally consists of a lower shielding shell 100 made of a metal sheet and defining a top wall 110, a right side wall 120, a left side wall 130, a bottom wall 150 and a rear end wall 140. An upper shielding shell 300 is also made of a metal sheet and defines a top wall 310, a right side wall 320 and a left side wall 330. A dielectric body 200 is mounted in the lower shielding shell 100 and located on a front portion of the bottom wall 150 and between the side walls 120 and 130. The dielectric body 200 defines four parallel trenches 210. Four contacts 220 are fixedly mounted to the dielectric body 200 by being fitted into the four trenches 210. A cable 240 has four leads 250 which are extended into the lower shielding shell 100 to electrically and mechanically connect with a terminal portion 230 of the contacts 220.

The bottom, left and right side walls 150, 130 and 120 of the lower shielding shell 100 have the same length, while the top wall 110 thereof has a shorter length and a front end being in coplanar with those of the bottom, left and right side walls 150, 130, and 120 and cooperating therewith to define a front opening (not labeled) for receiving a mating connector (not shown). Since the top wall 110 has a shorter length than the other walls 120, 130 and 150, an opened top 160 is formed at a rear portion the lower shielding shell 100, whereby the terminal portion 230 of the contacts 220 is not hindered by the top wall 110. This arrangement, a tool (not shown) can be directly and easily brought from the opened top 160 in a substantially vertical direction into the lower shielding shell 100 to perform a soldering or crimping operation to the terminal portion 230 to mechanically and electrically connect the leads 250 to the contacts 220.

A rectangular hole 115 is formed in the top wall 110 and located at a rear portion thereof. A locking key 125 is protruded from each of the right and left side walls 120, 130. The rear end wall 140 is divided into a left and right portion (not labeled) by a rear opening 170. Each portion has a rear extension 142 flaring rearwards from the rear end wall 140 to define an enlarged mouth (not labeled) for the rear opening 170, whereby the extension of the leads 250 into the lower shielding shell 100 can be easily achieved.

The upper shielding shell 300 is formed to have a hook-like tab 315 extending forward from a front end of the top wall 310 thereof. Two locking holes 325 (only one being shown) are formed in the right and left side walls 320, 330, respectively. Each locking hole 325 has a width sufficiently larger than that of the locking key 125. A cable retaining member 350 consists of a pair of jaws 352 extending downwards from a stem 354 of the cable retaining member 350 which is integrally connected with a rear end of the top wall 310. A reinforcing rib 356 is formed along the jaws 352 and the stem 354 to increase strength thereof, and gripping ability of the jaws 352 over the cable 240.

Particularly referring to FIG. 2(A), to assemble the lower and upper shielding shells 100, 300, firstly, the hook-like tab 315 is inserted into the hole 115 in the top wall 110 of the lower shielding shell 100. Then, as indicated by arrow A, the cable retaining member 350 is pushed downwards until the locking keys 125 are engaged with the side walls 320, 330 of the upper shielding shell 300 defining the locking holes 325, as shown by FIG. 2(B). In the present invention, since the locking holes 325 have a width sufficiently larger than that of the locking keys 125, it is not necessary to precisely align the locking holes 325 with the locking keys 125 in order to connect the lower and upper shielding shells 100, 300. Thus, the lower and upper shielding shells 100, 300 can be easily assembled. Furthermore, since the shielding shells 100, 300 are connected not only by the locking keys 125 and the side walls 320, 330 defining the locking holes 325 but also by the hook-like tab 315 and the top wall 110 defining the rectangular hole 115, the connected shielding shells 100, 300 can effectively withstand not only a vertical separating force but also a horizontal separating force acting thereon. It is noted that in FIG. 2(A), for the sake of clarity, the cable 240 is omitted therefrom.

After the lower and upper shielding shells 100, 300 are connected, the jaws 352 are subjected to a compressing force to cause them to move toward each other to securely clamp the cable 240 therebetween, whereby even if a large pulling force is exerted to the cable 240 relative to the connector 10, the leads 250 will not be easily separated from the contacts 220.

Figure 3:
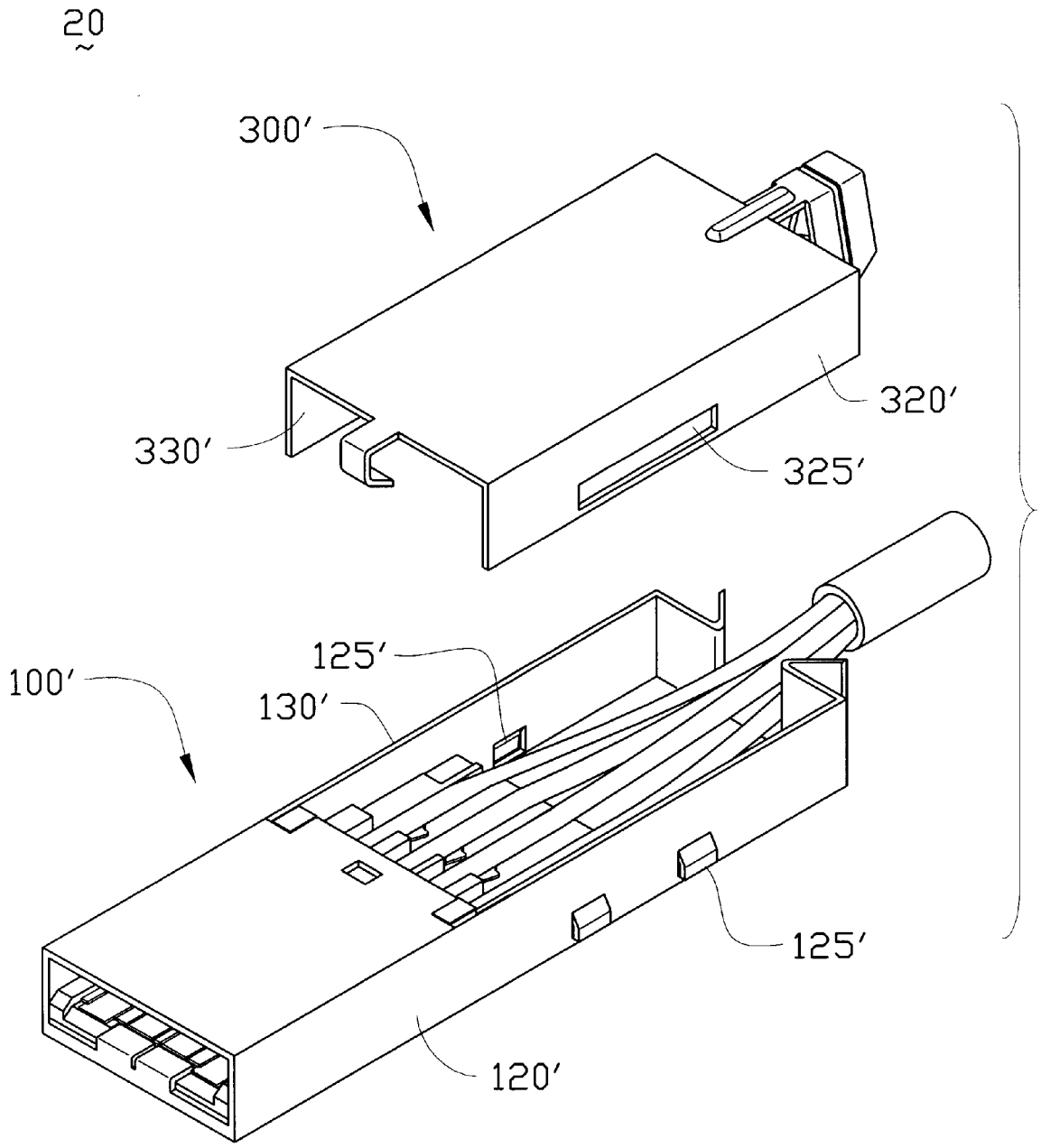
FIG. 3 is a view similar to FIG. 1, but shows a plug connector in accordance with a second embodiment of the present invention.
Figure 4:
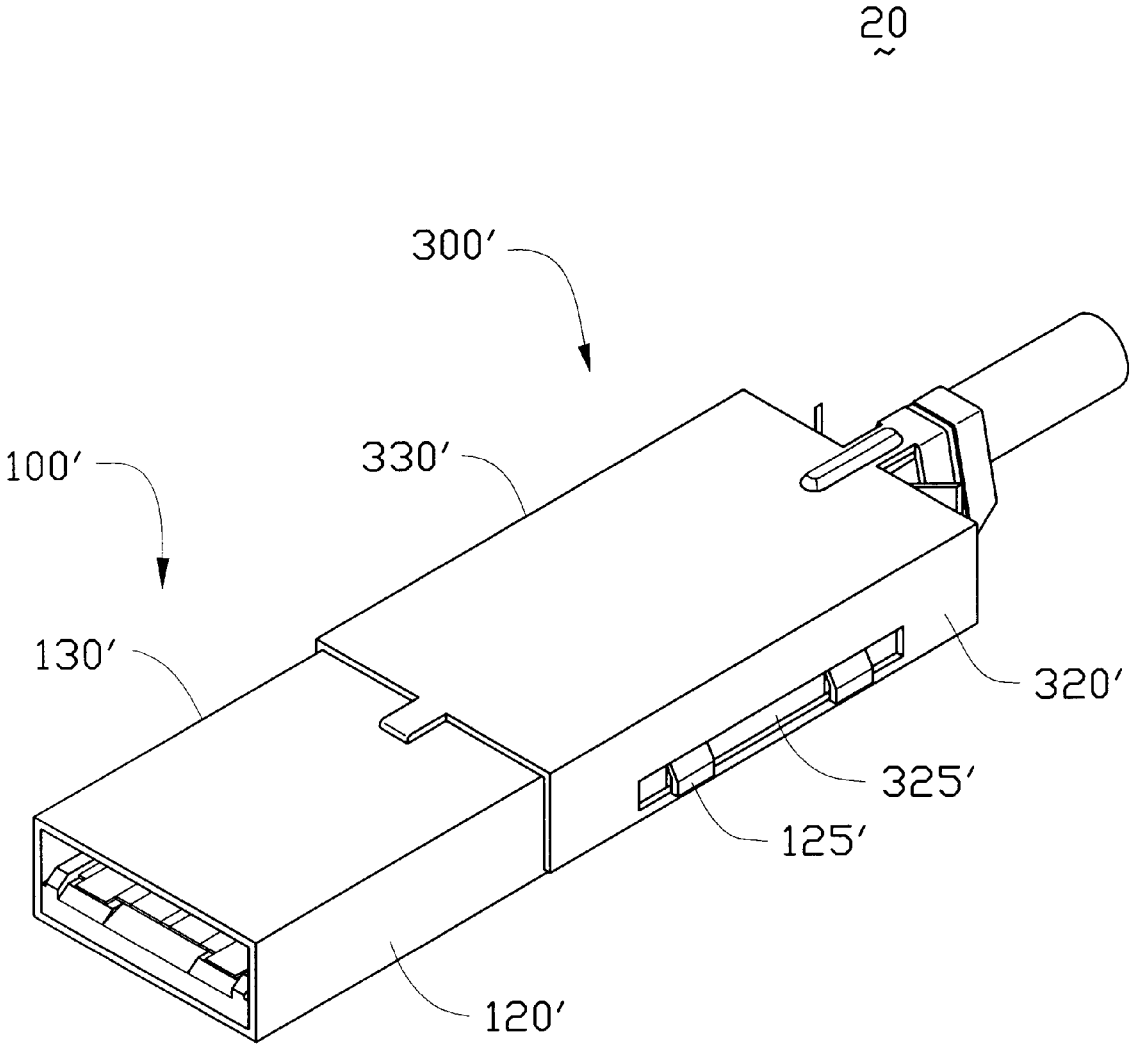
FIG. 4 is a perspective view showing the plug connector in accordance with the second embodiment of the present invention in an assembled state.

FIGS. 3 and 4 show a USB plug connector 20 in accordance with a second embodiment of the present invention. Except the following differences, the second embodiment is substantially the same as the first embodiment.

In the second embodiment, the USB plug connector 20 consists of a lower and upper shielding shell 100', 300'. The lower shielding shell 100' has side walls 120', 130' each defining two locking keys 125'. The upper shielding shell 300' has two side walls 320', 330' each defining a locking slot 325' in the form of an elongated hole and having a length which is sufficiently longer than a distance between the two locking keys 125' on a corresponding one of the side walls 120', 130'. In comparison with the first embodiment, the second embodiment can have a more secure connection to resist the vertical separating force acting on the connected shielding shells 100', 300', since each of the side walls 320', 330' of the upper shielding shell 300' is engaged with two locking keys 125'.

FIGS. 5 to 8 show a USB plug connector 30 in accordance with a third embodiment of the present invention. Like the first and second embodiments, the USB plug connector 30 also consists of a lower shielding shell 40 made by stamping and bending a metal sheet. An upper shielding shell 50 made also by stamping and bending a metal sheet. A dielectric body 60 made by plastics injection molding. Four contacts 70 made by stamping a copper sheet. And a cable has four leads. However, for the sake of simplicity, the cable is not shown in FIGS. 5 to 8.

The lower shielding shell 40 is formed to have a top wall 41, a bottom wall 42, a right side wall 43, a left side wall 44 and a rear end wall 45. Like the previous two embodiments, the top wall 41 has a length shorter than that of the other walls 42, 43, 44 and cooperates therewith to define a front opening 46 for receiving a mating connector (not shown). Two cutouts 412 are formed on two corners of a rear side of the upper wall 41, respectively, thereby to make the rear side of the top wall 41 have a certain degree of elasticity. Two rectangular holes 414 are formed in the top wall 41 near the rear side thereof. The bottom wall 42 is formed to have a large L-shaped stopping tab 462 extending upwards and rearwards from a front end thereof. Each of the right and left side walls 43, 44 is formed with two locking keys 432 protruding outwards therefrom, a recess 434 located rearward of the top wall 41, and a locking tab 436 located rearward of the recess 434. Two small L-shaped stopping tabs 424 are integrally formed by the bottom wall 42 and located rearward of the locking tabs 436. The rear end wall 45 has a structure the same as that of the first and second embodiments. Thus, detailed descriptions thereof are omitted here.

The upper shielding shell 50 is formed to have a top wall 52, a right and left side wall 54, 56 and a cable retaining member 55. The cable retaining member 55 has a structure the same as that of the previous embodiments. Thus, detailed descriptions thereof are omitted here. Each of the right and left side walls 54, 56 is formed to have two locking holes 542 and a recess 544 therein. The recesses 544 are formed for providing the side walls 54, 56 to have a certain degree of elasticity.

Like the previous embodiments, the dielectric body 60 is also formed with four trenches 62 for fittingly receiving the four contacts 70. A large depression 64 is formed at a front end of the body 60. Two small depressions 68 are formed at rear corners of the body 60, respectively. The body 60 further defines a middle raised portion 61 on which two mounting protrusions 66 and two stopping blocks 69 are formed, wherein the stopping blocks 69 are located at two rear corners of the raised portion 61, respectively.

To assemble the elements constituting the USB plug connector 30 in accordance with the third embodiment of the present invention, firstly, the contacts 70 are brought to extend along the trenches 62 to be fixedly received therein.

Figure 5:
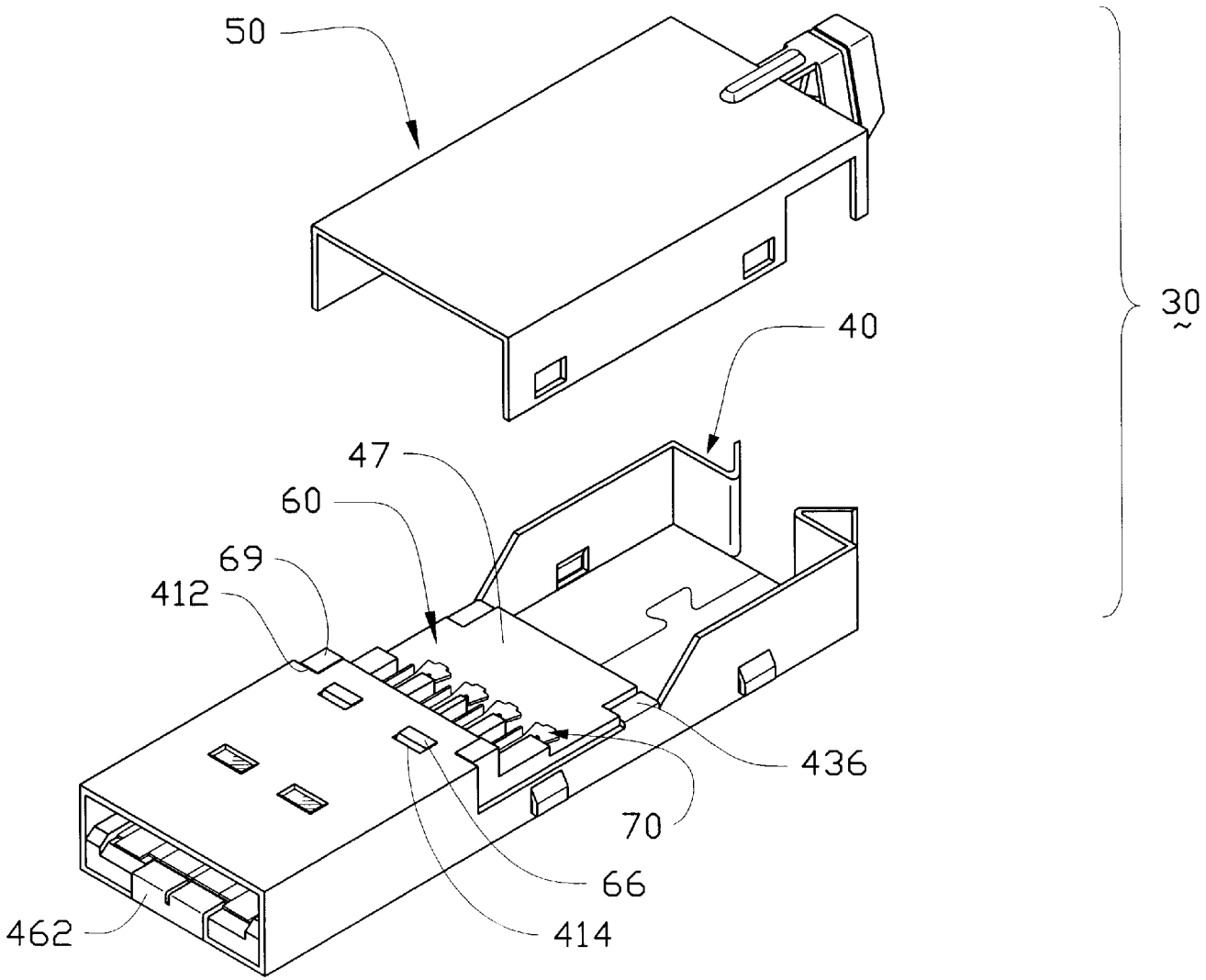
FIG. 5 is view similar to FIG. 1, but shows a plug connector in accordance with a third embodiment of the present invention.
Figure 6:
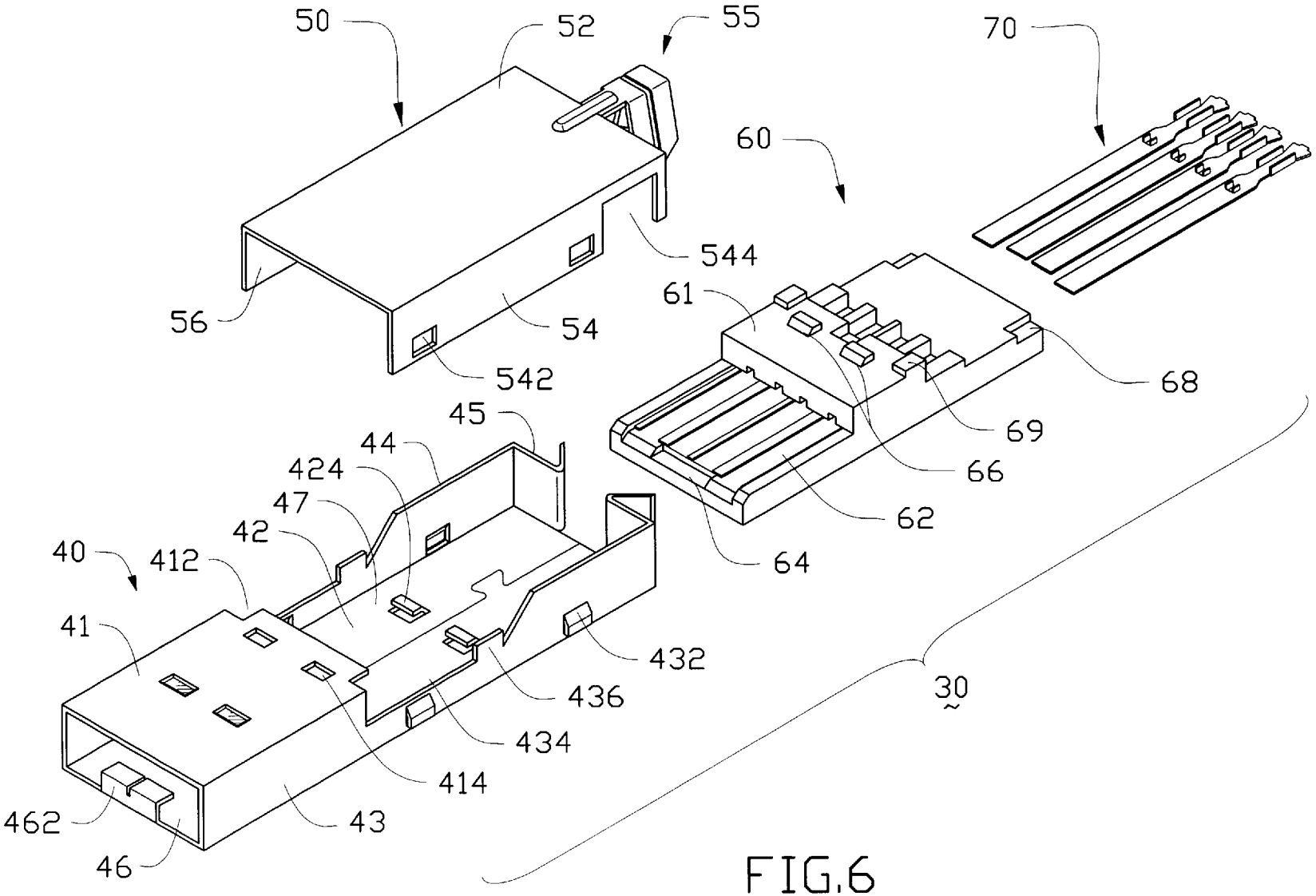
FIG. 6 is a perspective, exploded view showing the elements for constituting the plug connector of FIG. 5.
Figure 7:
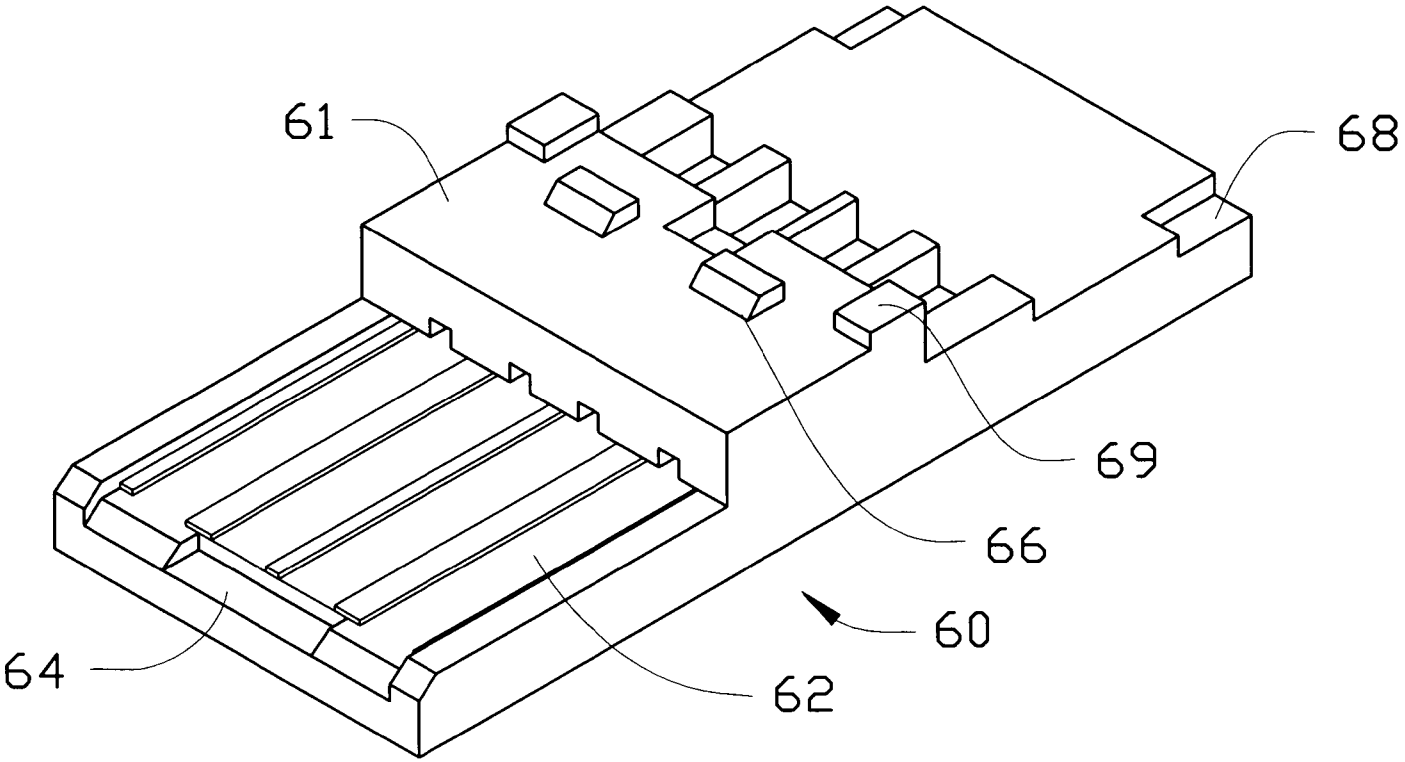
FIG. 7 is a perspective view showing a dielectric body for the plug connector of FIG. 5.
Figure 8:
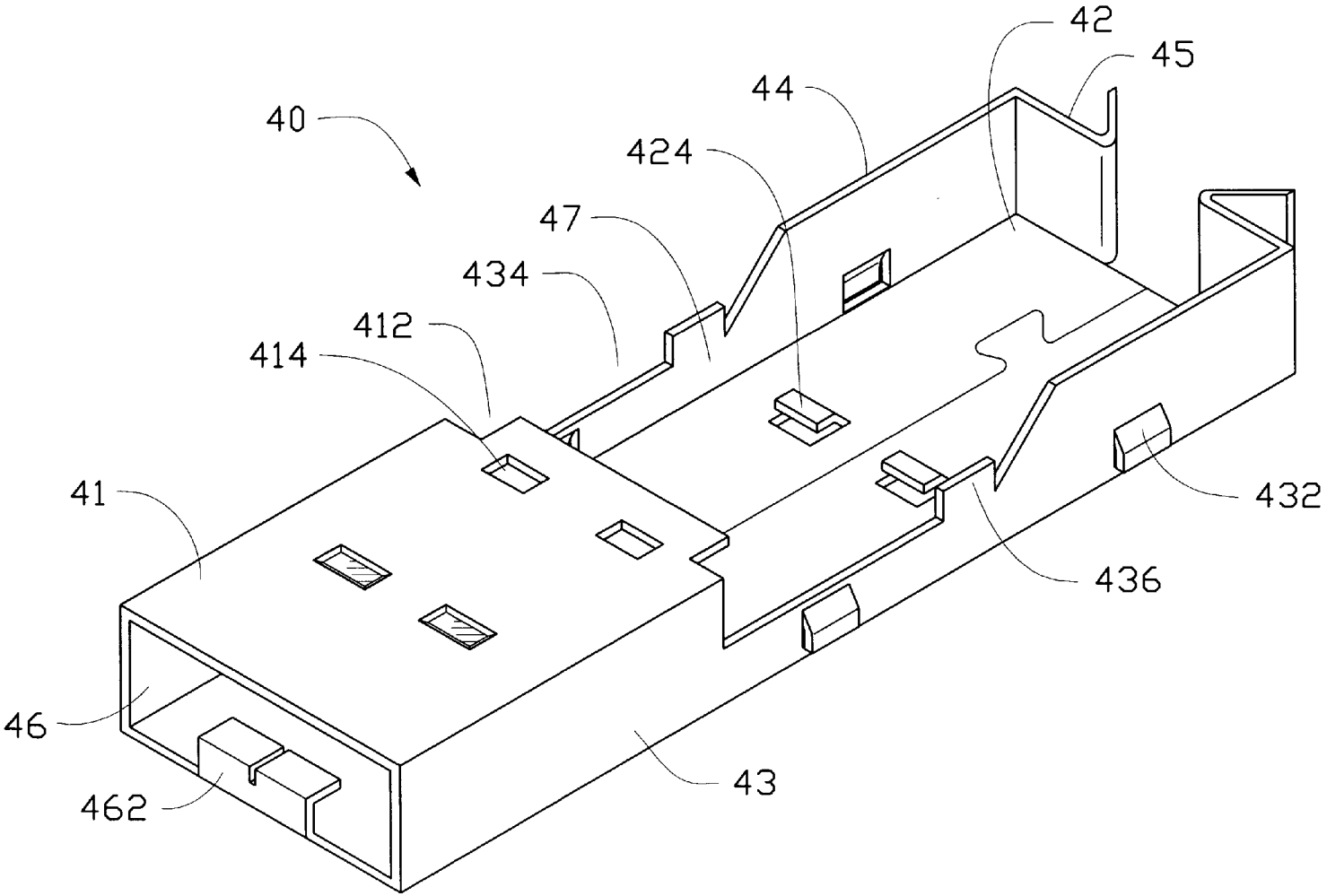
FIG. 8 is a perspective view showing a lower shielding shell for the plug connector of FIG. 5.

Then, the dielectric body 60 together with the contacts 70 is mounted to the lower shielding shell 40 by inserting the dielectric body 60 into a space defined within the top, bottom and side walls 41, 42, 43 and 44 of the lower shielding shell 40 to reach a location in which the large L-shaped stopping tab 462 engages the front end of the dielectric body 60 defining the large depression 64; the mounting protrusions 66 extend through the rectangular holes 414; the stopping blocks 69 engage the top wall 41 defining the cutouts 412; and the small L-shaped stopping tabs 424 engage a rear side of the dielectric body 60. As mentioned above, since the rear side of the top wall 41 of the lower shielding shell 40 has a certain degree of elasticity, to insert the dielectric body 60 into the space defined by the walls 41, 42, 43 and 44 can be easily achieved. Thereafter, the locking tabs 436 are bent toward the dielectric body 60 to engage with the dielectric body 60 defining the small depressions 68 at two rear corners thereof, as shown by FIG. 5. By this arrangement, the dielectric body 60 can be easily and securely mounted to the lower shielding shell 40. When the dielectric body 60 is mounted to the lower shielding shell 40, a terminal portion (not labeled) of the contacts 70 for connecting the leads of the cable (no shown) is located in alignment with the recesses 434 of the side walls 43, 44 and under an opened top 47 of the lower shielding shell 40 (better seen in FIG. 5).

Then, the leads of the cable (not shown) are brought to enter the lower shielding shell 40 through a rear opening (not labeled) defined by the rear end wall 45 to be electrically and mechanically connected to the contacts 70 by applying a soldering or crimping operation to the terminal portion of the contacts 70. In comparison with the previous embodiments, in the present embodiment, since the terminal portion of the contacts 70 is not hindered by the side walls 43, 44 from a lateral direction as the side walls 43, 44 are formed with the recesses 434 in alignment with the terminal portion of the contacts 70, a tool (not shown) can be brought to more easily approach the terminal portion of the contacts 70 to apply the crimping or soldering operation to complete the connection of the contacts 70 and the leads (not shown).

After the dielectric body 60 together with the contacts 70 is mounted to the lower shielding shell 40 and the contacts 70 are connected with the leads (not shown), the upper shielding shell 60 is brought to connect with the lower shielding shell 40 by pushing downwards the former toward the latter to reach a position in which the side walls 54, 56 of the upper shielding shell 50 defining the locking holes 542 are securely engaged with the locking keys 432 of the side walls 43, 44 of the lower shielding shell 40, and the top wall 52 of the upper shielding shell 50 covers the opened top 47 of the lower shielding shell 40 and the terminal portion of the contacts 70.

Finally, as the previous two embodiment, jaws (not labeled) of the cable retaining member 55 are pushed toward each other to fixedly clamp the cable (not shown) therebetween.

In the third embodiment, since the side walls 54, 56 of the upper shielding shell 50 are formed with a certain degree of elasticity (note: each of the side walls 54, 56 is formed with a recess 544), the connection of the side walls 54, 56 with the side walls 43, 44 can be easily achieved.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field shall understand that all such equivalent structures are to be included within the scope of the following claims.

I claim:

1. An electric connector, comprising:

a lower shielding shell having a top wall, two side walls and a bottom wall cooperatively defining a front opening, an opened top and a rear opening;

a dielectric body mounted into the lower shielding shell;

a number of contacts mounted to the dielectric body and defining a contact portion for electrically connecting with a mating connector extending through the front opening and a terminal portion located under the opened top;

a cable having a number of leads extending into the lower shielding shell through the rear opening and mechanically and electrically connected with the terminal portion of the contacts; and an upper shielding shell connected to the lower shielding shell and covering the opened top thereof;

wherein the top wall of the lower shielding shell has a substantially rectangular shape and defines two cutouts at two rear corners thereof and a mounting hole, the dielectric body forms a middle raised portion having a mounting key formed thereon, the mounting key extends through the mounting hole to engage with the top wall of the lower shielding shell, one of the side walls of the lower shielding shell defines a recess substantially in alignment with the terminal portion of the contacts, the dielectric body is substantially rectangular in shape and defines two first depressions at two rear corners thereof, and each of the side walls of the lower shielding shell is formed with a locking tab bent onto the dielectric body defining a corresponding first depression and engaging with the dielectric body.

2. The electric connector in accordance with claim 1, wherein the top wall of the lower shielding shell defines a hole, and the upper shielding shell comprises a second top wall covering the opened top of the lower shielding shell and defining a front edge having a hook-shaped tab extending through the hole to engage with the top wall of the lower shielding shell.

3. The electric connector in accordance with claim 2, wherein one of the side walls of the lower shielding shell defines a locking key and the upper shielding shell comprises a second side wall extending downwards from the second top wall and defining a locking hole which has a width sufficiently larger than that of the locking key, the locking key being extended through the locking hole to fixedly engage with the second side wall of the upper shielding shell.

4. The electric connector in accordance with claim 2, wherein one of the side walls of the lower shielding shell defines two locking keys and the upper shielding shell comprises a second side wall extending downward from the second top wall and defining a locking slot which has a length sufficiently larger than a distance between the two locking keys, the locking keys being extended through the locking slot to engage with the second side wall of the upper shielding shell.

5. The electric connector in accordance with claim 1 further comprises a cable retaining means for fixedly connecting with the cable to prevent the leads from separating from the contacts when a pulling force is exerted to the cable relative to the connector.

6. The electric connector in accordance with claim 5, wherein the upper shielding shell comprises a second top wall defining a rear edge, and the cable retaining means comprises a stem integral with the rear edge of the second top wall, a pair of jaws extending downwards from the stem and clamping the cable therebetween and a rib extending along the jaws to increase strength of the jaws and gripping ability of the jaws over the cable.

7. The electric connector in accordance with claim 1, wherein the rear opening has an enlarged mouth for facilitating the extension of the leads through the rear opening into the lower shielding shell.

8. The electrical connector in accordance with claim 1, wherein the raised portion is substantially rectangular in shape and further has two stopping blocks at two rear corners thereof, said two stopping blocks engaging the top wall of the lower shielding shell defining the cutouts.

9. The electrical connector in accordance with claim 1, wherein the upper shielding shell comprises a second top wall covering the opened top of the lower shielding shell and a second side wall extending downwards from the second top wall and fixedly engaging with one of the side walls of the lower shielding shell, the second side wall being formed with a recess.

10. An electric connector, comprising:

a lower shielding shell having a first top, bottom, right side and left side wall and defining an opened top, each first side wall defining a first recess in connection with the opened top;

a dielectric body fixedly mounted to the lower shielding shell;

a number of contacts fixedly mounted to the body and having a contact portion for connecting with a mating connector and a terminal portion located under the opened top and in alignment with the first recesses so that a tool can approach the terminal portion from the opened top and the first recesses to perform a crimping or soldering operation thereto;

a cable comprising a number of leads electrically and mechanically connected to the terminal portion of the contacts; and an upper shielding shell connected to the lower shielding shell and having a second top and right and left side walls covering the opened top and the first recesses of the lower shielding shell;

wherein the lower shielding shell has a front opening for receiving a mating connector, the dielectric body has a front end located near the front opening, the lower shielding shell comprises a first L-shaped stopping tab engaging the front end of the dielectric body, the dielectric body has a rear end opposite the front end thereof, and the lower shielding shell comprises a second L-shaped stopping tab engaging the rear end of the dielectric body.

11. The electric connector in accordance with claim 10, wherein each second side wall defines a second recess.

12. The electric connector in accordance with claim 10, wherein the lower shielding shell further has a rear opening through which the leads of the cable are extended to enter the lower shielding shell to electrically and mechanically connect with the terminal portion of the contacts, the connector further comprising a cable retaining member comprising two jaws integrally formed on a rear side of the upper shielding shell near the rear opening, said jaws securely clamping the cable therebetween.

13. The electric connector in accordance with claim 10, wherein the first recesses are formed about a middle portion of the first side walls of the lower shielding shell.

14. An electric connector, comprising:

a lower shielding shell having a top wall, two side walls and a bottom wall cooperatively defining a front opening, an opened top and a rear opening;

a dielectric body mounted into the lower shielding shell;

a number of contacts mounted to the dielectric body and each having a contact port ion for electrically connecting with a mating connector extending through the front opening and a terminal portion located under the opened top;

a cable having a number of leads extending into the lower shielding shell through the rear opening and mechanically and electrically connected with the terminal portion of the contacts; and an upper shielding shell connected to the lower shielding shell and covering the opened top thereof;

wherein the bottom wall of the lower shielding shell is formed with a first L-shaped stopping tab extending upward from a front end thereof into the lower shielding shell and a second L-shaped stopping tab about a middle portion thereof, the first L-shaped stopping tab engaging a front end of the dielectric body, and the second L-shaped stopping tab engaging a rear end of the dielectric body.

15. An electric connector, comprising:

a lower shielding shell having a first top, bottom, right side and left side wall and defining an opened top, each first side wall defining a first recess in connection with the opened top;

a dielectric body fixedly mounted to the lower shielding shell;

a number of contacts fixedly mounted to the body and having a contact portion for connecting with a mating connector and a terminal portion located under the opened top and in alignment with the first recesses so that a tool can approach the terminal portion from the opened top and the first recesses to perform a crimping or soldering operation thereto;

a cable comprising a number of leads electrically and mechanically connected to the terminal portion of the contacts; and an upper shielding shell connected to the lower shielding shell and having a second top and right and left side wall covering the opened top and the first recesses of the lower shielding shell;

wherein the first top wall is substantially rectangular in shape and defines two cutouts at two rear corners thereof and a mounting hole therein, the dielectric body defines a top face comprising a mounting key protruding upwards therefrom into the mounting hole to engage with the first top wall, and the first side walls define a locking tab bent toward the dielectric body and engaging therewith.

16. The dielectric connector in accordance with claim 15, wherein the lower shielding shell has a rear opening through which the leads are extended to enter the lower shielding shell to electrically and mechanically connect with the terminal portion of the contacts, the rear opening has an enlarged mouth to facilitate the extension of the leads therethrough to enter the lower shielding shell.

* * * * *